US006580207B2

(12) United States Patent
Lehner

(10) Patent No.: US 6,580,207 B2
(45) Date of Patent: Jun. 17, 2003

(54) DEFLECTION UNIT FOR A COLOR CATHODE RAY TUBE

(75) Inventor: Heinz Lehner, Oberschneiding (DE)

(73) Assignee: Matsushita Display Devices (Germany) GmbH, Esslingen (DE)

( * ) Notice: Subject to any disclaimer, the term of this patent is extended or adjusted under 35 U.S.C. 154(b) by 26 days.

(21) Appl. No.: 09/823,959

(22) Filed: Mar. 29, 2001

(65) Prior Publication Data

US 2001/0052748 A1 Dec. 20, 2001

(30) Foreign Application Priority Data

Mar. 29, 2000 (EP) ..... 00106714

(51) Int. Cl.[7] ..... H01J 29/70
(52) U.S. Cl. ..... 313/440
(58) Field of Search ..... 313/440, 439

(56) References Cited

U.S. PATENT DOCUMENTS 3,657,674 A 4/1972 Goldammer et al. ..... 348/828
4,130,836 A * 12/1978 Kornaker ..... 335/210
4,261,017 A * 4/1981 Branton ..... 335/212
5,498,921 A * 3/1996 Nishimura et al. ..... 313/2.1

FOREIGN PATENT DOCUMENTS

| | | |
|---|---|---|
| DE | 842 087 | 6/1952 |
| FR | 2245255 | 4/1975 |

* cited by examiner

*Primary Examiner*—Renee Luebke
*Assistant Examiner*—Ann M McCamey
(74) *Attorney, Agent, or Firm*—Boyle Fredrickson Newholm Stein & Gratz S.C.

(57) ABSTRACT

The present invention relates to a deflection unit for mounting on a color cathode ray tube. The deflection unit comprises a coil body for a vertical deflection coil and a first and second means for displacing the coil body into a first and second direction. The first and second directions are offset by 90° and are positioned in parallel with the screen plane of the color cathode ray tube. In a preferred embodiment of the invention the first and second means respectively comprise displacement bow members which can be displaced by means of a screw. The screws are preferably identical. To secure the Z-position, the coil body is preferably slid into a cap and rotated in the stop position.

21 Claims, 4 Drawing Sheets

DEFLECTION UNIT FOR A COLOR CATHODE RAY TUBE

BACKGROUND OF THE INVENTION

1. Field of the Invention

The present invention relates to a deflection unit for mounting on a color cathode ray tube and is, in particular, concerned with positioning and adjusting the vertical coil in such a deflection unit.

2. Description of the Related Art

Deflection units are mounted on a cathode ray tube to deflect the electron beams across the screen in X- and Y-direction. The deflection unit consists essentially of two pairs of coils and a ferrite core which serves to return the magnetic flux. The one pair of coils produces a magnetic field which deflects the electron beams in horizontal direction (X-direction) while the other pair of coils serves vertical deflection (Y-direction).

During mounting of such a deflection unit the auxiliary vertical coil is first finished by winding a coil wire onto a prefabricated coil body and is then installed in the deflection unit. Tolerances of the components create deviations in the positions of the vertical coil, which might result in convergence and geometry errors. Therefore, after the vertical coil has been positioned, an adjusting operation is required for obtaining an optimum picture quality.

However, the adjustments known in the prior art are either too inaccurate or require complex devices which make the manufacture of such a deflection unit expensive.

OBJECTS AND SUMMARY OF THE INVENTION

It is therefore the object of the present invention to provide a deflection unit for mounting on a color cathode ray tube which permits an easier positioning and adjustment of the vertical coil. Furthermore a corresponding color cathode ray tube and an associated display apparatus shall be provided.

According to the invention this object is achieved by a deflection unit for mounting on a color cathode ray tube which comprises a coil body for a vertical deflection coil and first and second means for displacing the coil body in a first and second direction. The first and second directions are offset by about 90° and are substantially positioned in parallel with the screen plane of the color cathode ray tube.

The invention permits a separate adjustment of the position of the vertical coil in X- and Y-direction in an advantageous manner.

Moreover, the deflection unit of the invention has a compact constructional shape so that it can easily be mounted on the neck of a color cathode ray tube.

In a preferred development of the invention each of the first and second means comprises a guided displacement bow member which can be displaced by means of a screw. Thanks to the constructionally identical design of the screws the manufacture of the deflection unit is further simplified.

When the vertical deflection coil is inserted into a cap of the deflection unit until it reaches a stop and when it is then rotated for fixing purposes, the positioning of the vertical coil relative to the Z-direction can be further simplified with respect to its manufacture.

Preferred developments of the invention are indicated in the subclaims.

BRIEF DESCRIPTION OF THE DRAWINGS

The invention will now be explained in more detail with reference to the attached drawings, in which.

DETAILED DESCRIPTION OF THE PREFERRED EMBODIMENT

An embodiment of the invention shall now be explained in more detail with reference to the attached drawings.

Figure 1:
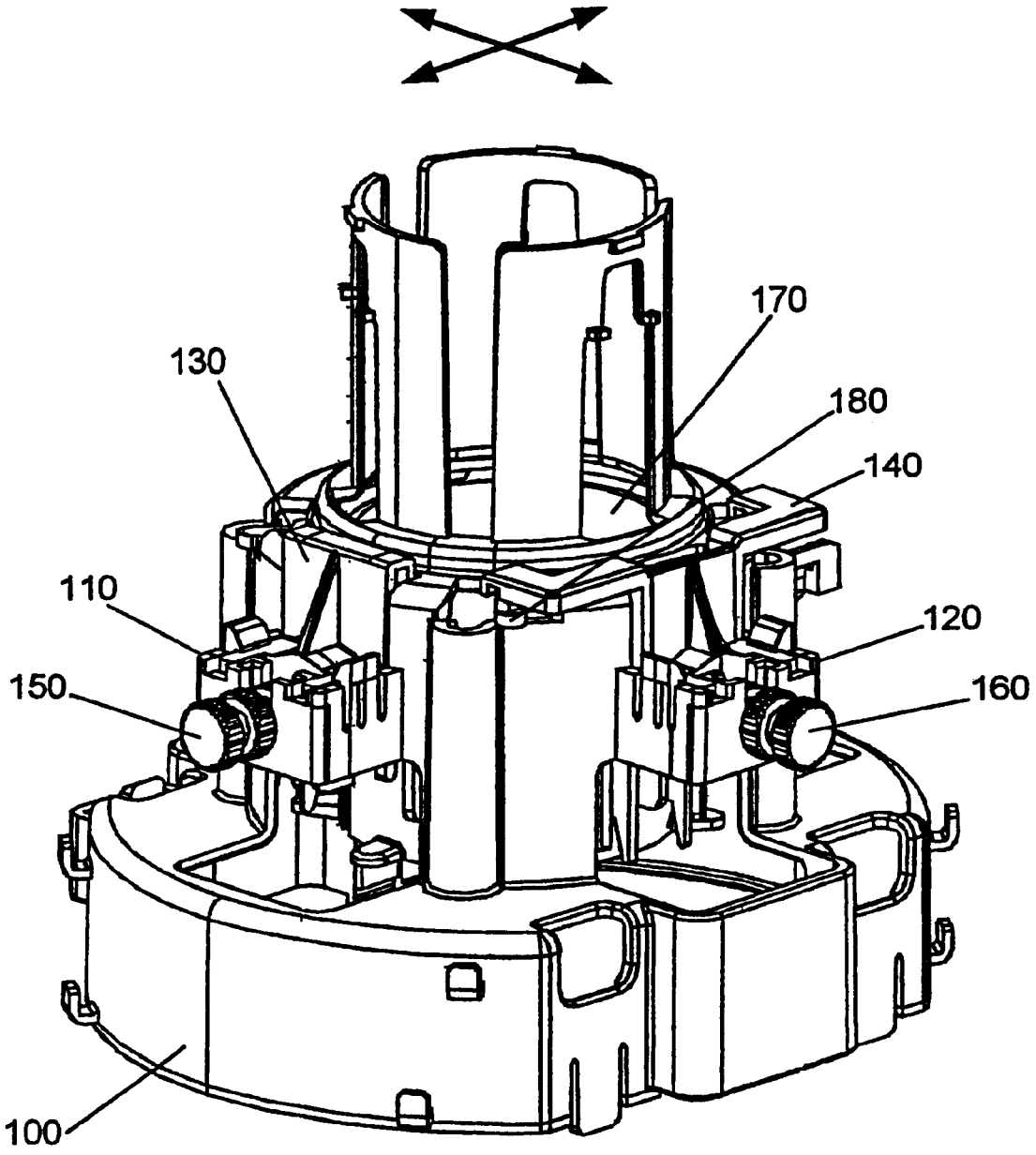
FIG. 1 shows the subassembly for positioning and adjusting the vertical coil in a preferred embodiment of the deflection unit according to the invention

FIG. 1 shows the subassembly used for positioning and adjusting the vertical coil. The subassembly consists of a cap 100 which comprises two projecting displacement balconies 110,120 arranged at an angle of 90° The displacement balconies have inserted thereinto displacement bow members 130, 140 which by means of adjusting screws 150,160 are displaceable to be guided in the displacement balconies 110,120. Furthermore, a coil body 170 of the vertical coil is slid from below into the cap 100. The coil body 170 is connected to the displacement bow members 130 and can thus be displaced by rotating screws 150, 160 along the directions shown by the double-headed arrows in FIG. 1.

The positioning and adjustment of the vertical coil shall now be explained in more detail with reference to FIGS. 2 to 5.

Figure 2:
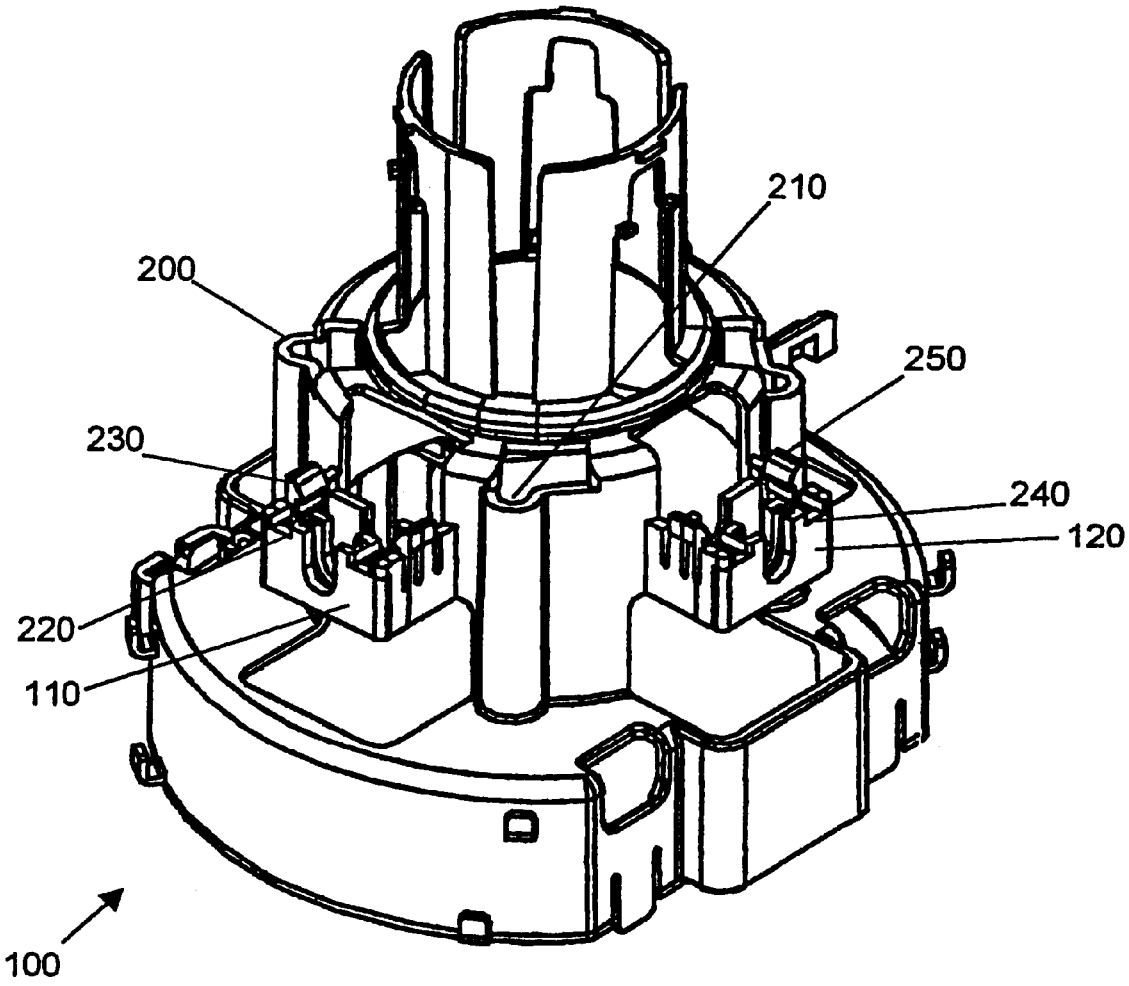
FIG. 2 shows the cap belonging to the subassembly.

FIG. 2 is a view of cap 100. The displacement balconies 110,120 comprise guide grooves 220, 240 in which the displacement bow members 130, 140 are displaceable in a guided manner. Furthermore, respective locking elements 230, 250 are provided for retaining the displacement bow members 130,140 in the displacement balconies.

Figure 3:
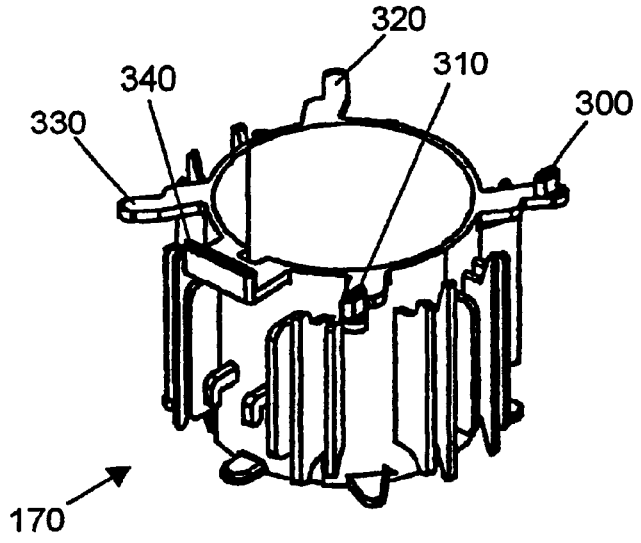
FIG. 3. shows the coil body belonging to the subassembly.

FIG. 3 is an oblique view showing the coil body 170 as it is slid from below with the wound-on coil wires into the cap illustrated in FIG. 2. The coil body 170 first includes four noses 320, 330 that upon insertion of the coil body are guided in respectively associated recesses 200, 210 of the cap. As can be seen in FIG. 1 under reference numeral 180, the coil body 170, which has fully been slid into the cap, is secured in its stop position by rotating the cap. During this rotation the noses 320, 330 slide over a collar of the cap 100, so that the coil body is secured in its Z-position. A preferred angle of rotation is about 10°.

As can also be seen in FIG. 3, the coil body 170 comprises ribs 300, 310, 340, of which two ribs are seated on the above-mentioned noses. Ribs 300, 310, 340 serve to position and adjust the vertical coil.

FIGS. 4*a*, 4*b*, 5*a* and 5*b* show the angular displacement bow members 130,140 with the respectively associated adjusting screws 150,160. The displacement bow members 130, 140 are first provided with guide rails 410, 420, 520,

530 that are inserted into the grooves 220, 240 and respectively held from above by the locking elements 230, 250. Moreover, the displacement bow members 130, 140 comprise gripping collars 500, 510 which in the mounted arrangement grip over the ribs 300, 310, 340, thereby securing the position of the coil body 170 in the respective direction. Since the displacement bow members 130 and 140 are arranged to be offset by 90°, the respective displacement bow member fixes the position of the coil body only in one direction whereas freedom of movement is still ensured in the direction perpendicular thereto.

Thus, the invention first makes it possible to secure the Z-position of the vertical coil by insertion up to the stop and by subsequent rotation of the coil body. The displacement bow members are then clipped into the corresponding displacement balconies, whereupon the vertical coil is displaceable by simple rotation of the corresponding adjusting screws in X- and Y-direction.

Figure 4A:
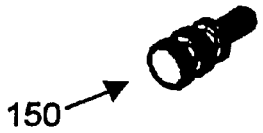
FIG. 4*a* shows an adjusting screw belonging to the subassembly.
Figure 4B:
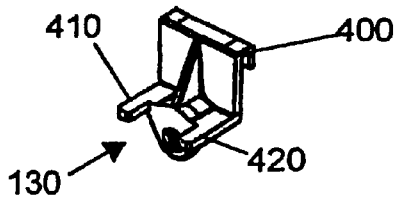
FIG. 4*b* shows a displacement bow member belonging to the subassembly.
Figure 5A:
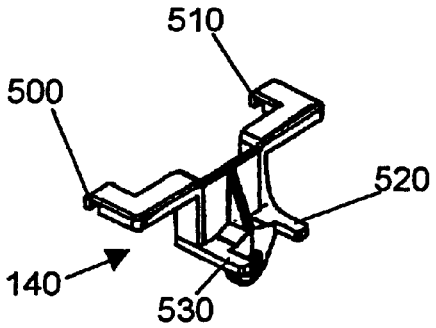
FIG. 5*a* shows another displacement bow member belonging to the subassembly.
Figure 5B:
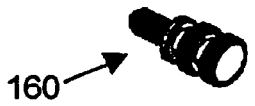
FIG. 5*b* shows another adjusting screw belonging to the subassembly.

The adjusting screws 150,160 shown in FIG. 4*a* and FIG. 5*b* are preferably of the same construction.

Figure 6:
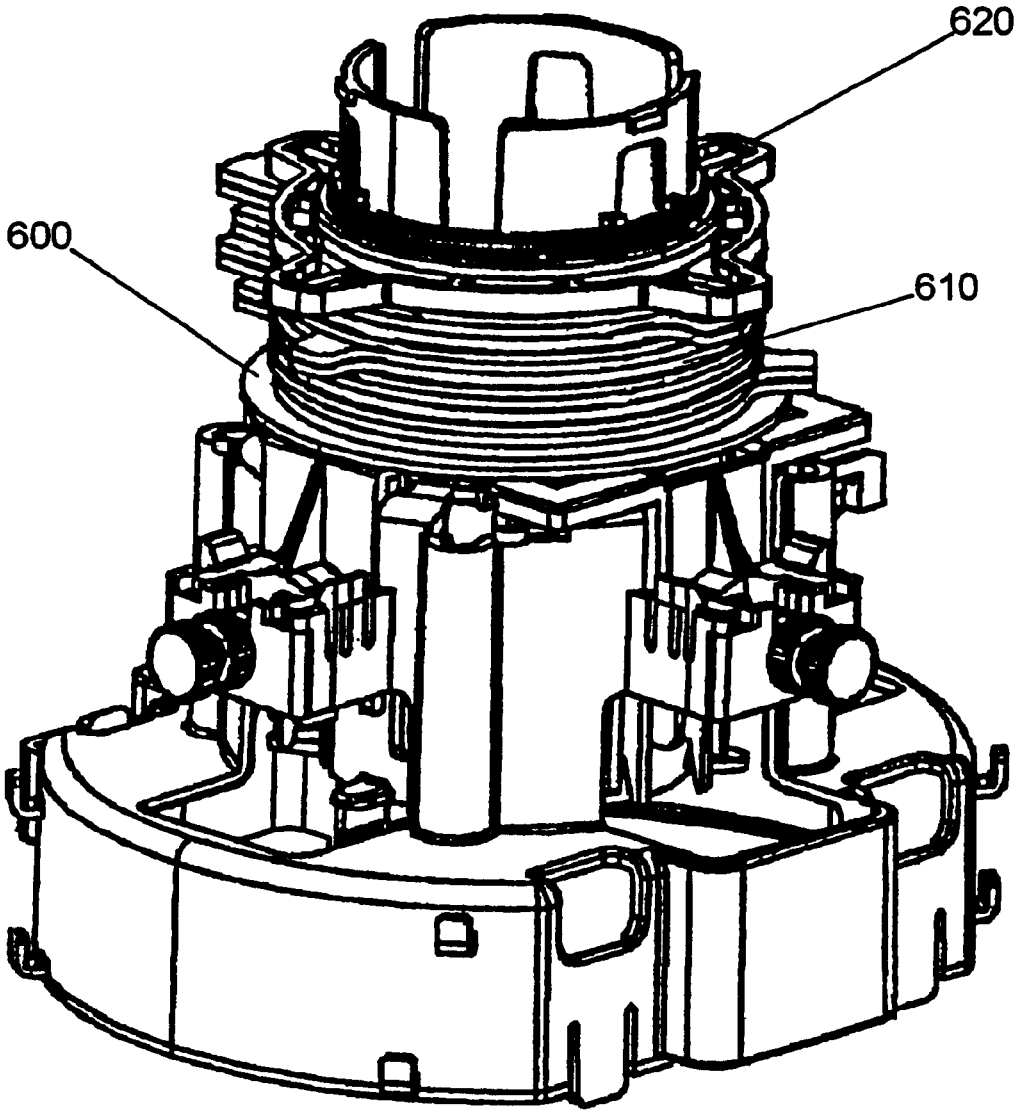
FIG. 6 shows the subassembly of FIG. 1 with an equipped carrier tube.

FIG. 6 shows the subassembly of FIG. 1 with subsequently further mounted elements. As can be seen from the illustration, a carrier tube 600, several magnet and spacer rings 610 as well as a threaded ring 620 are mounted after the coil body has been inserted and the displacement bow member clipped in.

The deflection unit according to the invention is preferably used in "pure flat" type picture tubes

What is claimed is:

1. A deflection unit for mounting on a color cathode ray tube, comprising:

a cap, a coil body for a vertical deflection coil, said coil body being movably mounted within said cap, first means for displacing the coil body with respect to said cap in a first direction, and second means for displacing the coil body with respect to said cap in a second direction, wherein the first and second directions are offset by 90° and are positioned in parallel with a screen plane of the color cathode ray tube.

2. The deflection unit according to claim 1, wherein the cap and the coil body are configured such that the Z-position of the vertical deflection coil can be secured by inserting the coil into the cap until it reaches a stop and by subsequent rotation of the coil.

3. The deflection unit according to claim 1, wherein the coil body is slid from below into the cap.

4. The deflection unit according to claim 1, further comprising coil wires that are wound on the coil body, wherein the coil body and the coil wires are slid from below into the cap.

5. The deflection unit according claim 1, wherein each of the first and second means comprises a guided displacement bow member which can be displaced via a corresponding one of first and second screws into the respective direction.

6. The deflection unit according to claim 5, wherein said first and second screws are of identical construction.

7. The deflection unit according to claim 5, wherein the cap comprises two displacement balconies with means for clipping in the displacement bow members.

8. The deflection unit according to claim 5, wherein the displacement bow members are made angular, each comprising at least one gripping collar for respectively gripping over at least one rib of the coil body, thereby fixing the coil body only in the respective direction.

9. The deflection unit according to claim 1, wherein the coil body includes noses and the cap includes recesses, and wherein the noses are guided into the recesses.

10. The deflection unit according to claim 9, wherein the cap includes a collar that is configured and dimensioned to secure the noses into the cap upon rotation of the cap.

11. A color cathode ray tube comprising a deflection unit that includes:

a cap, a coil body for a vertical deflection coil, said coil body being movably mounted within said cap, first means for displacing the coil body with respect to said cap in a first direction, second means for displacing the coil body with respect to said cap in a second direction, and wherein the first and second directions are offset by 90° and are positioned in parallel with the screen plane of the color cathode ray tube.

12. The color cathode ray tube according to claim 11, wherein the cap and the coil body are configured such that the Z-position of the vertical deflection coil can be secured by inserting the coil into the cap until it reaches a stop and by subsequent rotation of the coil.

13. The color cathode ray tube according claim 11, wherein each of the first and second means each comprises a guided displacement bow member which can be displaced via a corresponding one of first and second screws into the respective direction.

14. The color cathode ray tube according to claim 13, wherein the two screws are of identical construction.

15. The color cathode ray tube according to claim 13, wherein the cap comprises two displacement balconies with means for clipping in the displacement bow members.

16. The color cathode ray tube according to claim 13, wherein the displacement bow members are made angular, each comprising at least one gripping collar for respectively gripping over at least one rib of the coil body, thereby fixing the coil body only in the respective direction.

17. A display apparatus comprising a color cathode ray tube and a deflection unit, the display apparatus comprising:

a cap, a coil body for a vertical deflection coil, said coil body being movably mounted within said cap, first means for displacing the coil body with respect to said cap in a first direction, second means for displacing the coil body with respect to said cap in a second direction, and wherein the first and second directions are offset by 90° and are positioned in parallel with the screen plane of the color cathode ray tube.

18. The display apparatus according claim 17, wherein each of the first and second means each comprises a guided displacement bow member which can be displaced via a corresponding one of first and second screws into the respective direction.

19. The display apparatus according to claim 18, wherein the two screws are of identical construction.

20. The display apparatus according to claim 18, wherein the cap comprises two displacement balconies configured so that the displacement bow members can be clipped in corresponding ones of the displacement balconies.

21. The display apparatus according to claim 18, wherein the displacement bow members are made angular, each comprising at least one gripping collar for respectively gripping over at least one rib of the coil body, thereby fixing the coil body only in the respective direction.

* * * * *